US010426213B2

(12) United States Patent
Hyman

(10) Patent No.: US 10,426,213 B2
(45) Date of Patent: Oct. 1, 2019

(54) TOTAL CONTACT HELMET

(71) Applicant: Stephen Craig Hyman, West Bloomfield, MI (US)

(72) Inventor: Stephen Craig Hyman, West Bloomfield, MI (US)

(73) Assignee: Kranos IP Corporation, Litchfield, IL (US)

( * ) Notice: Subject to any disclaimer, the term of this patent is extended or adjusted under 35 U.S.C. 154(b) by 468 days.

(21) Appl. No.: 14/564,367

(22) Filed: Dec. 9, 2014

(65) Prior Publication Data

US 2015/0157081 A1 Jun. 11, 2015

Related U.S. Application Data

(60) Provisional application No. 61/913,586, filed on Dec. 9, 2013.

(51) Int. Cl.

| | |
|---|---|
| ***A42B 3/00*** | (2006.01) |
| ***A42B 3/12*** | (2006.01) |
| ***A42B 3/06*** | (2006.01) |
| ***A42C 2/00*** | (2006.01) |
| *A63B 71/10* | (2006.01) |

(52) U.S. Cl.

CPC ..... *A42B 3/121* (2013.01); *A42B 3/06* (2013.01); *A42B 3/12* (2013.01); *A42C 2/007* (2013.01); *A63B 71/10* (2013.01)

(58) Field of Classification Search

CPC ..... A42B 3/12; A42B 3/121; A42B 3/122; A42B 3/124; A42B 3/125; A42B 3/127; A42B 3/18; A42B 3/06; A42B 3/00; A42B 3/32; A42B 3/322; A42B 3/324; A42B 3/328; A42C 2/007; A63B 71/20

USPC ..... 2/410–415, 417, 418, 423–425

See application file for complete search history.

(56) References Cited

U.S. PATENT DOCUMENTS

| | | | | | |
|---|---|---|---|---|---|
| 1,280,684 | A | * | 10/1918 | Domanski | A42B 3/08 2/421 |
| 3,373,443 | A | * | 3/1968 | Marietta | A42B 3/20 2/424 |
| 3,725,956 | A | * | 4/1973 | Reisen | A42B 1/02 2/171 |
| 3,992,722 | A | * | 11/1976 | Rhee | A63B 71/10 2/411 |

(Continued)

FOREIGN PATENT DOCUMENTS

| | | | | | |
|---|---|---|---|---|---|
| DE | 3607583 | A1 | * | 9/1987 | A42B 3/063 |
| GB | 1496140 | A | * | 12/1977 | A42B 3/00 |

*Primary Examiner* — Jameson D Collier

(74) *Attorney, Agent, or Firm* — Kohn and Associates, PLLC

(57) ABSTRACT

A total contact helmet, including a body that is customizable to an individual's head and having force distribution means for distributing the force of an impact to a large surface area of the body. A total contact helmet insert, including a body that is customizable to an individual's head and having force distribution means for distributing the force of an impact to a large surface area of the body, the total contact helmet insert being insertable under an existing helmet or as an inner shell as part of an existing helmet. A method of protecting the head of a user by the user wearing the total contact helmet, and when receiving an outside impacting force to the total contact helmet, distributing the force of impact over the surface area of the total contact helmet.

8 Claims, 8 Drawing Sheets

(56) References Cited

U.S. PATENT DOCUMENTS 4,058,854 A * 11/1977 Rhee ..... A63B 71/10 2/412
4,075,717 A * 2/1978 Lemelson ..... A42B 3/065 2/412
4,279,038 A * 7/1981 Bruckner ..... A63B 71/10 2/417
4,706,305 A * 11/1987 Cho ..... A42B 3/00 2/417
4,754,501 A * 7/1988 Yahn ..... A42B 3/20 2/424
4,776,324 A * 10/1988 Clarren ..... A42B 3/00 2/171.2
4,809,690 A * 3/1989 Bouyssi ..... A42B 1/08 128/857
5,094,229 A * 3/1992 Pomatto ..... A61F 5/01 128/857
5,177,815 A * 1/1993 Andujar ..... A42B 3/00 2/411
5,687,426 A * 11/1997 Sperber ..... A42B 3/061 2/411
5,787,513 A * 8/1998 Sharmat ..... A42B 3/328 2/411
5,913,412 A * 6/1999 Huber ..... A42B 3/28 2/413
6,088,840 A * 7/2000 Im ..... A42B 3/00 2/411
6,108,825 A * 8/2000 Bell ..... A41D 31/005 2/16
6,389,608 B1 * 5/2002 Williams ..... A42B 3/00 2/411
6,986,168 B2 * 1/2006 Abelman ..... A42B 3/00 2/412
7,096,513 B1 * 8/2006 Kress ..... A42B 3/328 2/410
8,528,119 B2 * 9/2013 Ferrara ..... A42B 3/063 2/455
8,572,767 B2 * 11/2013 Bryant ..... A42B 3/08 2/171.1
2007/0266480 A1 * 11/2007 Tovo ..... A42B 3/328 2/411
2008/0189835 A1 * 8/2008 Mangone ..... A42B 3/324 2/420
2013/0326798 A1 * 12/2013 Clement ..... A42B 3/12 2/418
2014/0298571 A1 * 10/2014 Dagan ..... A42B 3/12 2/411

* cited by examiner

TOTAL CONTACT HELMET

BACKGROUND OF THE INVENTION

1. Technical Field

The present invention relates to helmets for protection of a user's head in sports and other activities. More specifically, the present invention relates to customizable helmets and inserts.

2. Background Art

Helmets are designed to protect the head and brain and are used in a variety of activities and sports. Many helmets include a layer of crushable foam that crushes upon contact in order to control the crash energy and extend the stopping time of the head in order to reduce peak impact to the brain. The crushable foam is contained within a plastic skin. Often, as with bicycle helmets, once an impact has taken place, the foam does not recover to its original shape and must be replaced with a new helmet. Other types of helmets have a slow-rebound foam (butyl nitrate foam, or expanded polypropylene foam) that recover slowly after an impact and are reusable.

U.S. Pat. No. 8,528,119 to Ferrara discloses an impact-absorbing protective structure comprises one or more compressible cells that can be used in helmets. Each cell is in the form of a thin-walled plastic enclosure defining an inner, fluid-filled chamber with at least one small orifice through which fluid resistively flows. Each cell includes an initially resistive mechanism that resists collapse during an initial phase of an impact and that then yields to allow the remainder of the impact to be managed by the venting of fluid through the orifice. The initially resistive mechanism may be implemented by providing the cell with semi-vertical side walls of an appropriate thickness or by combining a resiliently collapsible ring with the cell. After the initially resistive mechanism yields to the impact, the remainder of the impact is managed by the fluid venting through the orifice. The cell properties can be readily engineered to optimize the impact-absorbing response of the cell to a wide range of impact energies. While the cells can be customized to a particular use of the helmet such as with materials of fabrication, size, geometry, etc., the helmet is not manufactured to be customized for a specific individual's head.

In physics, pressure equals force/area (P=F/A). If a person steps on a nail, it will puncture skin, whereas if a person lays on a bed of 1,000 nails, the skin is not punctured because the contact surface area is increased 1,000 fold and thus decreasing the pressure 1,000 fold. Even small changes in surface area have a dramatic decrease in pressure. For example, a sharp knife cuts through a steak very easily, whereas a dull knife requires a lot of effort to cut.

In medicine, the concept of total contact to decrease pressure of force of impact is well documented and studied. In an amputee, the weight of the body is transmitted through the bones. If one just put on an extension to weight bear the skin will break down over the area, or vectors of force, where bones transmit weight. Thus, total contact casting, created by casting with a reverse mold, and creating a total contact fit for a prosthesis is used to decrease pressure and markedly decrease any skin breakdown. Total contact casting is also used for ankle fracture immobilization, which all but eliminates heel decubitous ulcers by spreading out pressure over the area of total surface contact.

There remains a need for a helmet that can be customized to an individual's head and can more effectively reduce force of an impact.

SUMMARY OF THE INVENTION

The present invention provides for a total contact helmet including a body that is customizable to an individual's head and is able to distribute the force of an impact to a large surface area of the body.

The present invention provides for a total contact helmet insert including a body that is customizable to an individual's head and having force distribution means for distributing the force of an impact to a large surface area of the body, the total contact helmet insert being insertable under an existing helmet or as an inner shell as part of an existing helmet.

The present invention provides for a method of protecting the head of a user, by the user wearing the total contact helmet, and when receiving an outside impacting force to the total contact helmet, distributing the force of impact over the surface area of the total contact helmet.

DESCRIPTION OF THE DRAWINGS

Other advantages of the present invention are readily appreciated as the same becomes better understood by reference to the following detailed description when considered in connection with the accompanying drawings wherein:

FIGS. 7A and 7B are graphs of concussion risk curves based on brain tissue response parameters wherein FIG. 7A shows brain maximum strain times and FIG. 7B shows brain maximum principal strain.

DETAILED DESCRIPTION OF THE INVENTION

Figure 1:
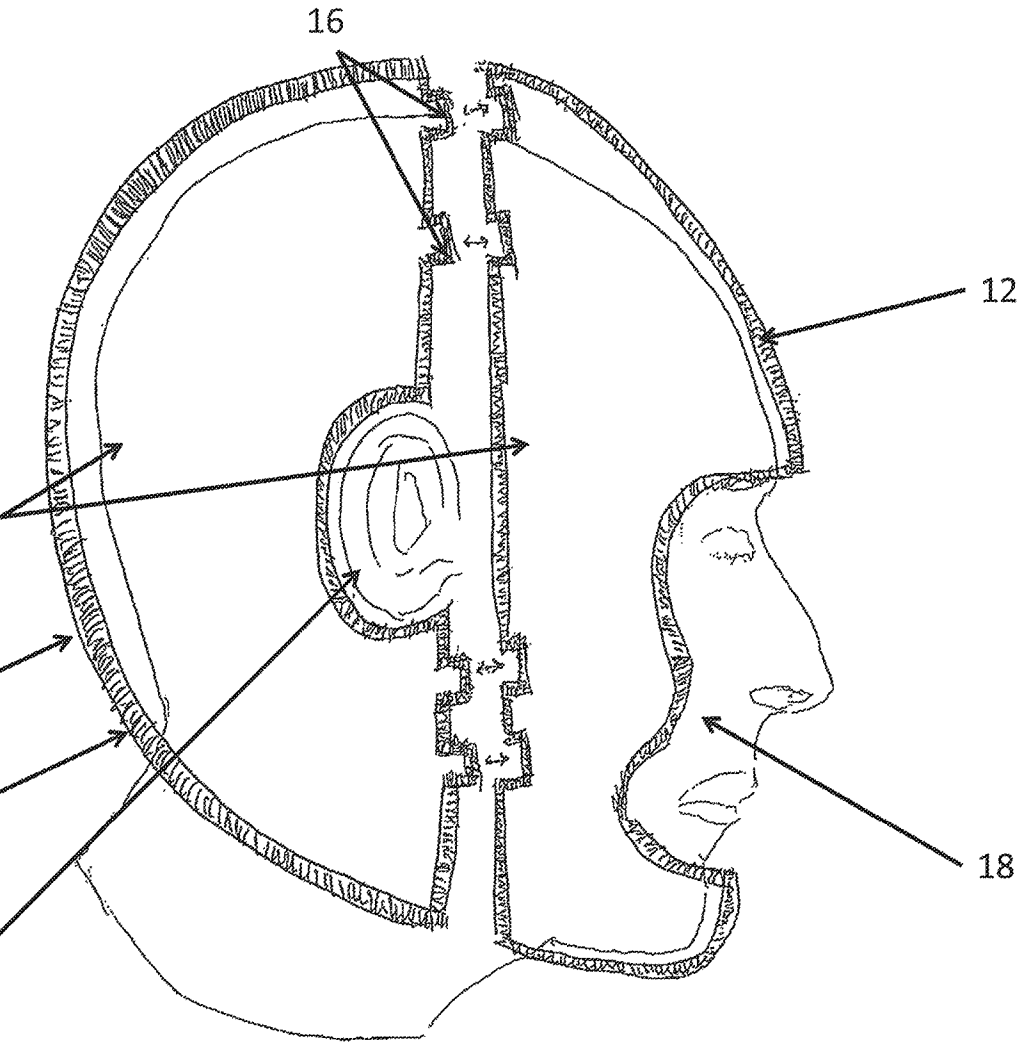
FIG. 1 is a side view of the total contact helmet.
Figure 2:
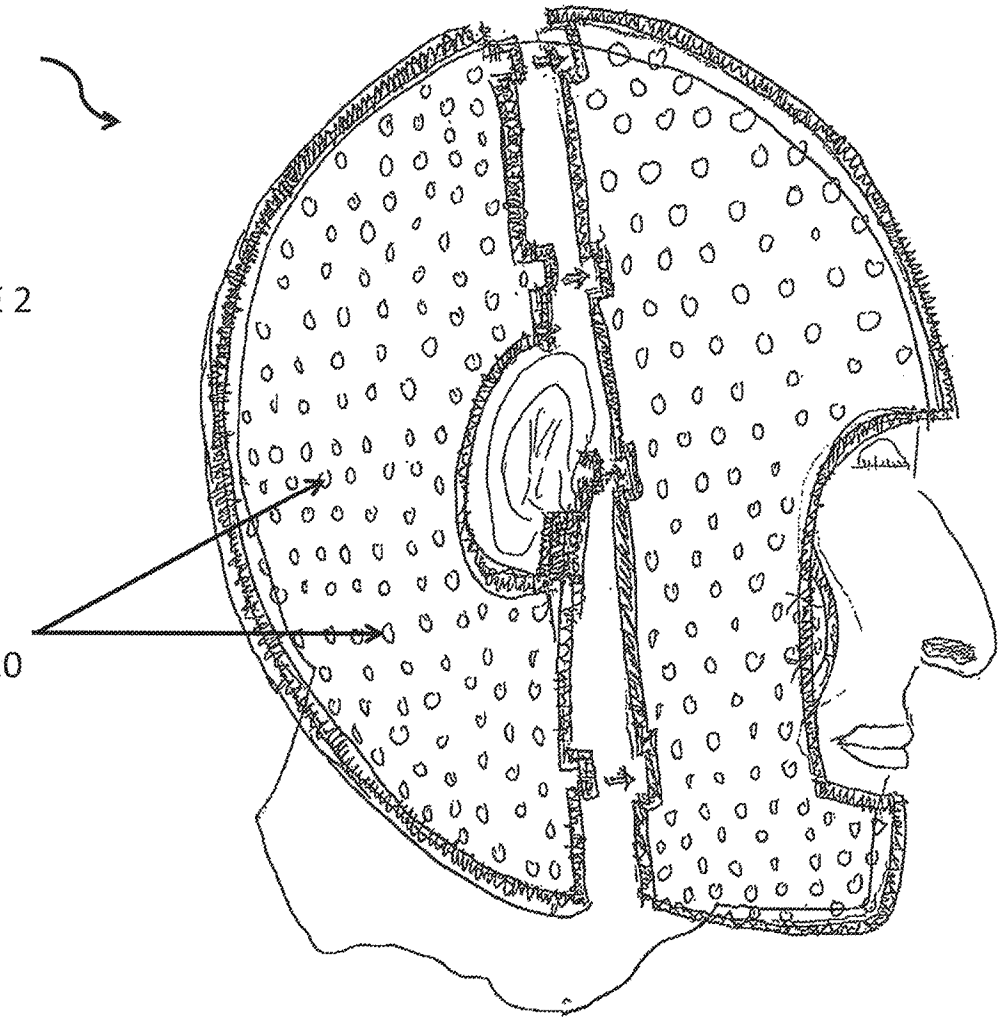
FIG. 2 is a side view of the total contact helmet with ventilation holes.
Figure 3:
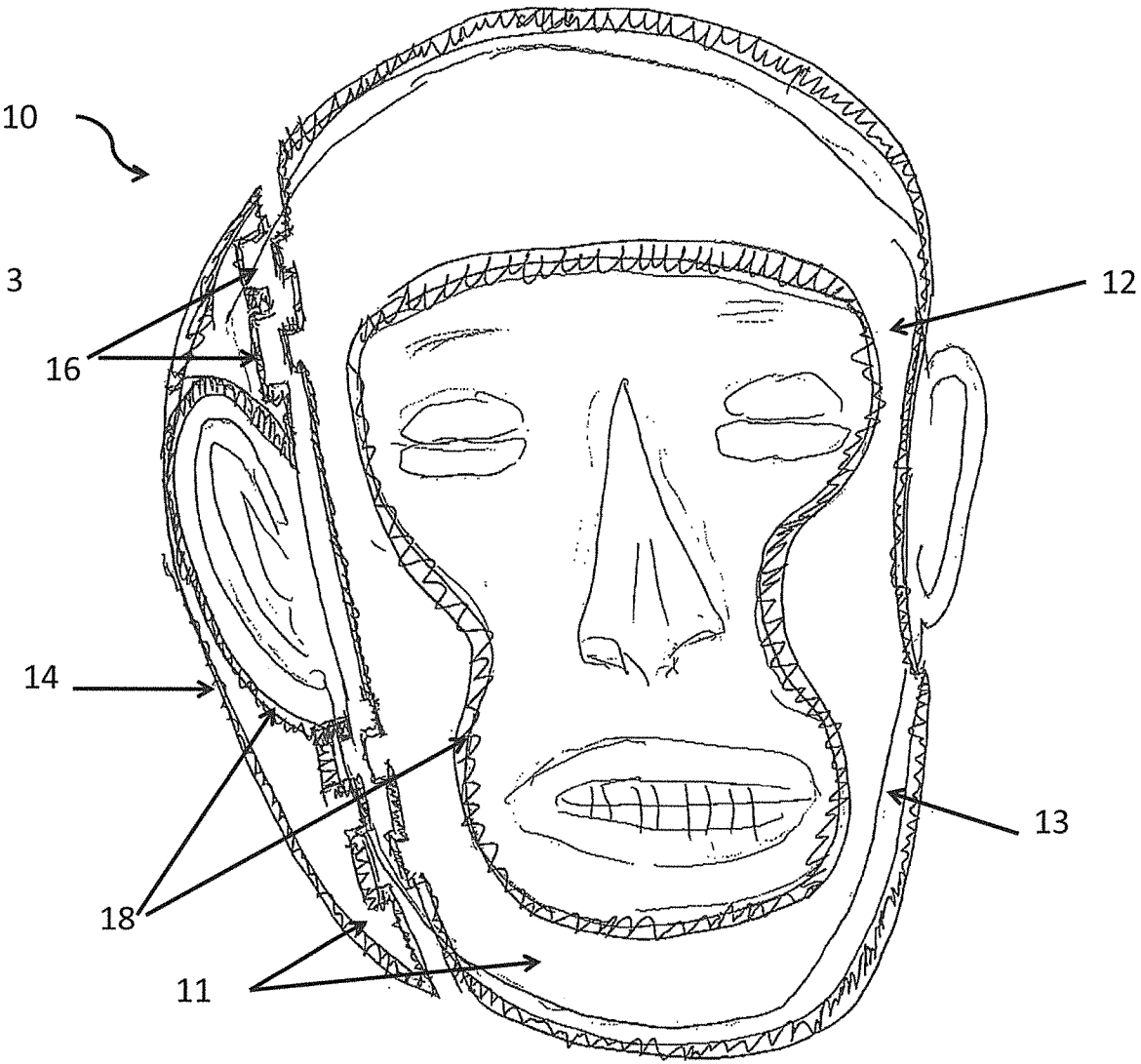
FIG. 3 is a front view of the total contact helmet.

The present invention generally provides for a total contact helmet 10 including a body 11 that is customizable to an individual's head and is able to distribute the force of an impact with a force distribution mechanism 13 to a large surface area of the helmet 10, as shown in FIGS. 1-3. The total contact helmet 10 laterally displaces force and disperses the impact vector to a large area, rather than transmitting force to the skull and brain as in prior art designs.

The total contact helmet 10 can be made of any suitable material that serves the function to spread an impact to a larger surface area and thus decrease pressure to the skull and brain of a user. In other words, the force distribution mechanism 13 is preferably the material of the total contact helmet 10. The material can be, but is not limited to, hard plastic, carbon fiber technology, hard rubber filled with fluid, or an air bladder. The material can also be arranged in any suitable manner to spread the impact to a larger surface area. For example, the total contact helmet 10 can include honeycombed rectangle wafers such that a first wafer that receives an impact transmits force to two wafers in a second layer, and the two wafers transmit force to four wafers in the third layer, etc. This transmits the force of impact laterally and decreases pressure as the force is transmitted through multiple layers.

Preferably, the total contact helmet 10 is designed and customized to fit an individual's head. There is preferably zero space between the surface of a user's head and the total contact helmet 10 (i.e. the body 11) when worn. The total contact helmet 10 can be in the form of a mask or a combination of a mask with a helmet or any other suitable design for a helmet. Preferably, the total contact helmet 10 covers every part of the user's body that a conventional helmet would cover.

The total contact helmet 10 provides a total contact with the skull and face, and can be made circumferentially by a traditional cast and reverse mold or modern scan technology by 3D reconstruction or 3D printing technology. In other words, a cast can be made of the individual's head, or a 3D scan can be made of the individual's head.

The total contact helmet 10 can preferably be made as an insert ½ inch+/−½ inch that is at least two pieces (such as front piece 12 and back piece 14) held together by at least one interlock 16 or other technology to create total contact with significant surface area of the entire exact topical surface of entire surface of the head. Front piece 12 can fit over the user's face, and back piece 14 can fit over the user's back part of the head. Interlocks 16 can snap in place and can be pushed to close in order to connect the front piece 12 and back piece 14. The interlocks 16 can be unsnapped and the front piece 12 separated from the back piece 14 to remove the total contact helmet 10. Alternatively, the total contact helmet 10 can be made of a single piece.

Interlocks 16 allow maximal surface contact with the user's head to provide circumferential force distribution that changes the force vector of impact in the side, front, and back of the total contact helmet 10 by decreasing the total pressure and increasing surface area of contact. This is different than any other 3D inserts or protective facial head devices in the prior art in that the circumferential design distributes force such that a frontal, side, or back impact will not cause the brain to move around in the skull as much because the force vector will be from all sides and will diminish this force. This is also known as the coup-contra-coup trauma that is involved in concussions and traumatic brain injuries. The design of the interlocks 16 and total contact helmet 10 thus decreases these forces and decreases these injuries.

Cut outs 18 can be included for the mouth, nose, ears, chin, and neck, as well as other customizations such as for a cut out of a ponytail, etc.

The total contact helmet 10 can include a ventilation mechanism 20 of ventilation holes or slits that can be anywhere suitable to provide adequate ventilation without decreasing surface area significantly to decrease impact reduction, as shown in FIG. 2. The shape of the ventilation mechanism 20 and color of the total contact helmet can be customized to meet needs of the manufacturer, i.e. a company logo (e.g. NIKE™'s swoosh) or team represented (i.e. block M's for THE UNIVERSITY OF MICHIGAN™ or S's for MICHIGAN STATE UNIVERSITY™ (MSU™), etc.). The total contact helmet 10 can be further personalized with colors that represent the team using the helmet or individual's preferences (i.e. green for MSU football players, red, white, and blue for USA Olympic downhill ski racers).

Figure 6:
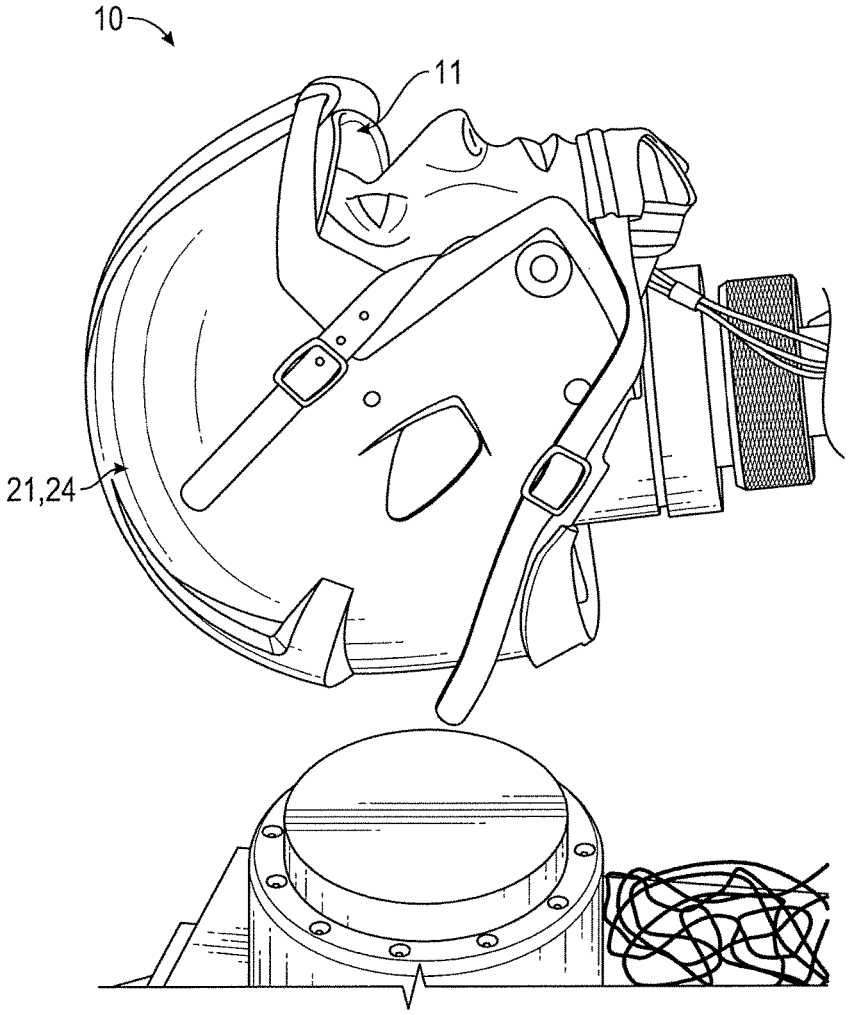
FIG. 6 is a photograph of a helmeted headform with an example of the helmet of the present invention.

The total contact helmet 10 can be manufactured as an insert that fits under existing helmets 20 or as an inner shell as part of an existing helmet 20 (as worn under an existing helmet is shown in FIG. 6), or it can be directly manufactured as a stand-alone helmet and include a hard outside shell made of plastics, thermoplastics, fiberglass, carbon composites, or any other suitable materials.

Therefore, the present invention also provides for a total contact helmet insert, including a body that is customizable to an individual's head and having force distribution means for distributing the force of an impact to a large surface area of said body, the total contact helmet insert being insertable into an existing helmet. The total contact helmet insert can have any of the properties as described above.

Figure 8:
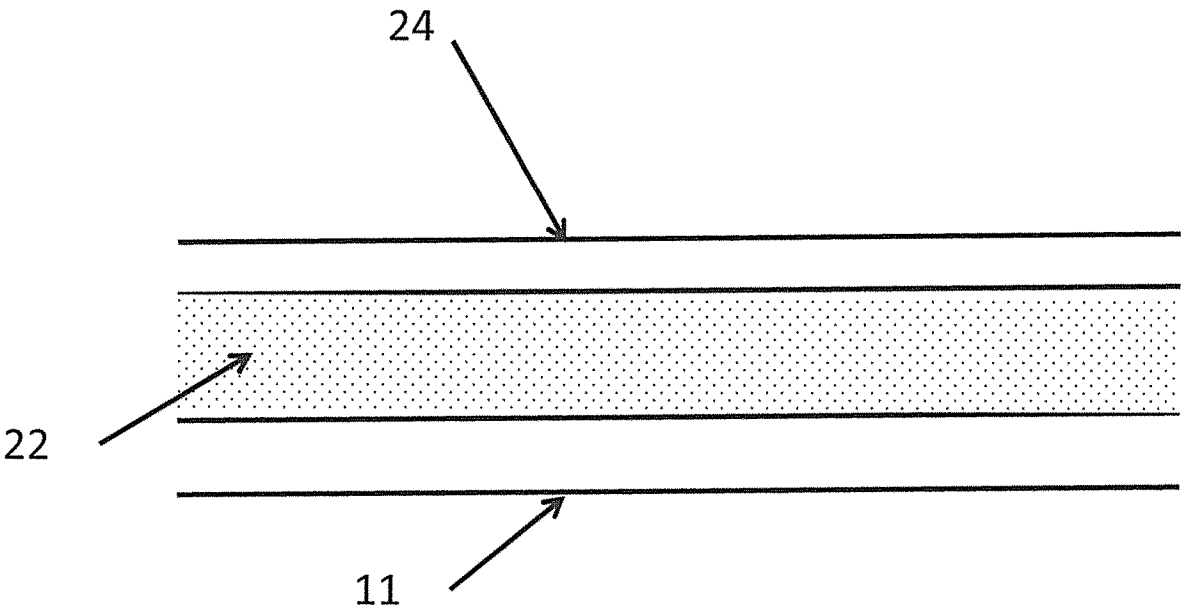
FIG. 8 is a cross-sectional view of the total contact helmet with an energy absorption mechanism.

The total contact helmet 10 can also include an energy absorption mechanism 22 that allows for increased energy absorption between the total contact helmet 10 and a hard outside shell 24 (wherein the hard outside shell 24 is either part of the total contact helmet 10 itself or a separate existing helmet as described above), shown in FIG. 8 in cross-sectional view. The energy absorption mechanism 22 can be disposed between the body of the total contact helmet 10 and the hard outside shell 24 at all contact points between the body and the hard outside shell 24. The energy absorption mechanism can be, but is not limited to, foam, matrices, springs, shock absorbing materials, magnetic forces from opposing magnets, or any other suitable mechanism. No shearing forces are present with the energy absorption mechanism. The technology of the present invention allows for increased energy absorption without shearing forces because of the total contact of the total contact helmet 10 with the user's head.

The total contact helmet 10 can be used for many different sports or activities, such as, but not limited to, baseball (catchers, batters, other players), umpires, hockey (goalies and other players), football, bicycling, motorcycling, boxing, wrestling, rugby, field hockey, skiing, snowboarding, skateboarding, military uses, construction uses, or any other sport or activity that involves contact with other individuals or objects.

The present invention provides for a method of protecting the head of a user, by the user wearing the total contact helmet, and when receiving an outside impacting force to the total contact helmet, distributing the force of impact over the surface area of the total contact helmet. The design of the total contact helmet reduces the force over the entire portion of the body that the helmet covers (i.e. the skull, head, or face if in a mask form). The interlocking circumferential design changes the force vector of impact at the sides, front, and back of the helmet by decreasing total pressure by increasing surface area of contact. Coup-contra-coup forces are also decreased that are involved in concussion and traumatic brain injuries. The method can further include increasing energy absorption between the total contact helmet and a hard outside shell and decreasing the impact of the outside impacting force on the brain by providing the energy absorption mechanism described above.

The present invention provides for a method of reducing concussions and head injuries, by a user wearing the total contact helmet, and when receiving an outside impacting force to the total contact helmet, distributing the force of impact over the surface area of the total contact helmet.

The total contact helmet of the present invention provides several advantages. The outer shell of helmets can disperse impacts and prevent skull fractures, but the present invention can also protect the brain by decreasing risk of concussion and head injury. Not all injury is diffuse axonal injury, and as shown in the Example below, the total contact helmet can disperse energy and decrease areas of strain and decrease the risk of concussion by 25% over RIDDELL™'s best NFL™ helmet. This is particularly advantageous with frontal impacts, which is of large concern with catcher's masks. Also, when used as an insert, the total contact helmet can provide a perfect custom fit that allows an increase of energy absorption between the insert and an outer shell (i.e. existing helmet).

The invention is further described in detail by reference to the following experimental examples. These examples are provided for the purpose of illustration only, and are not intended to be limiting unless otherwise specified. Thus, the invention should in no way be construed as being limited to the following examples, but rather, should be construed to encompass any and all variations which become evident as a result of the teaching provided herein.

Example 1

Summary

The objective of the study was to evaluate the energy dissipation performance of the helmet First Impact Reducing Surface Total Contact (First Contact) design of the present invention when it was incorporated with the modern football helmet. A combined series of standard helmet impact test, helmet-to-helmet impact test and computer modeling using a detailed human head model were conducted to quantify and assess the resulting global head responses and brain tissue responses to a range of helmet impact conditions. These biomechanical response parameters were compared between the helmeted head with and without use of the First Contact product. The risk of brain injury was assessed according to mild traumatic brain injury risk curves developed previously using NFL™ brain injury data.

Methods, Results, and Injury Prediction

1. NOCSAE Football Helmet Drop Test

Method

Figure 4:
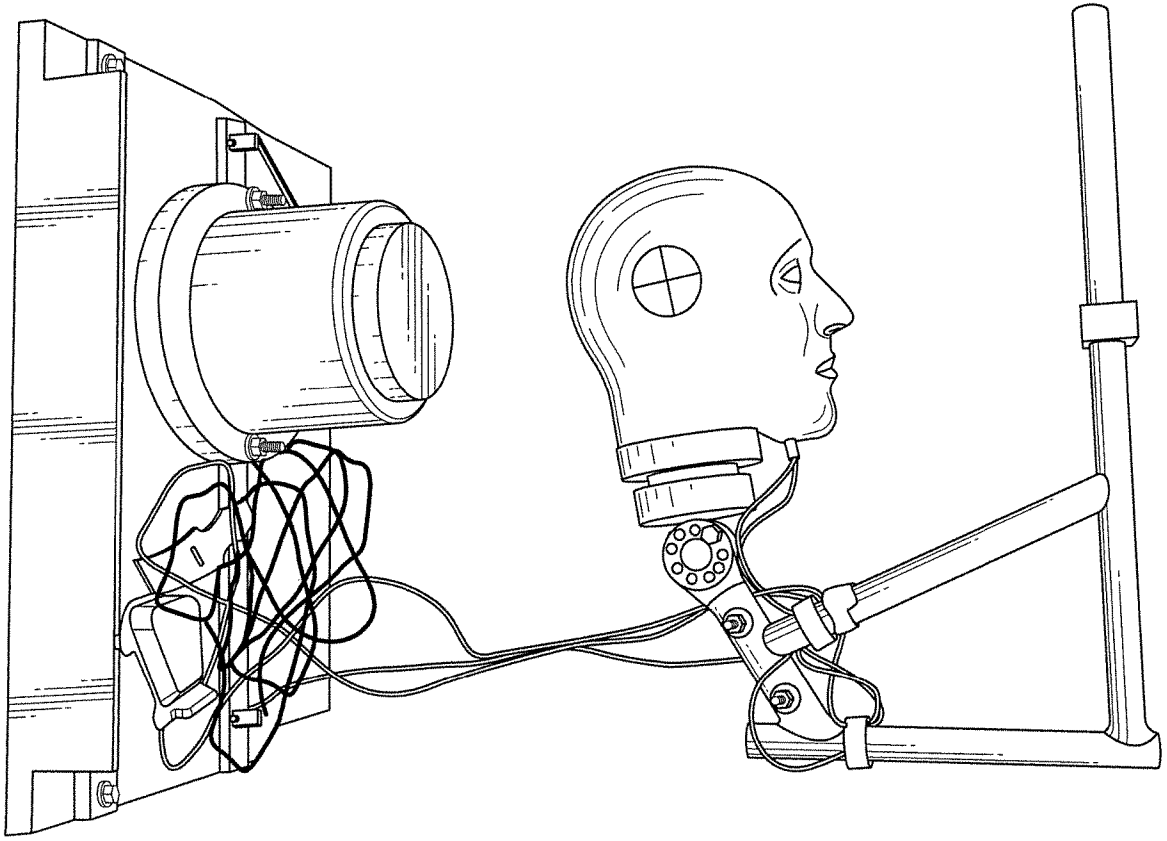
FIG. 4 is a photograph of a NOCSAE drop test setup in Example 1.
Figure 5:
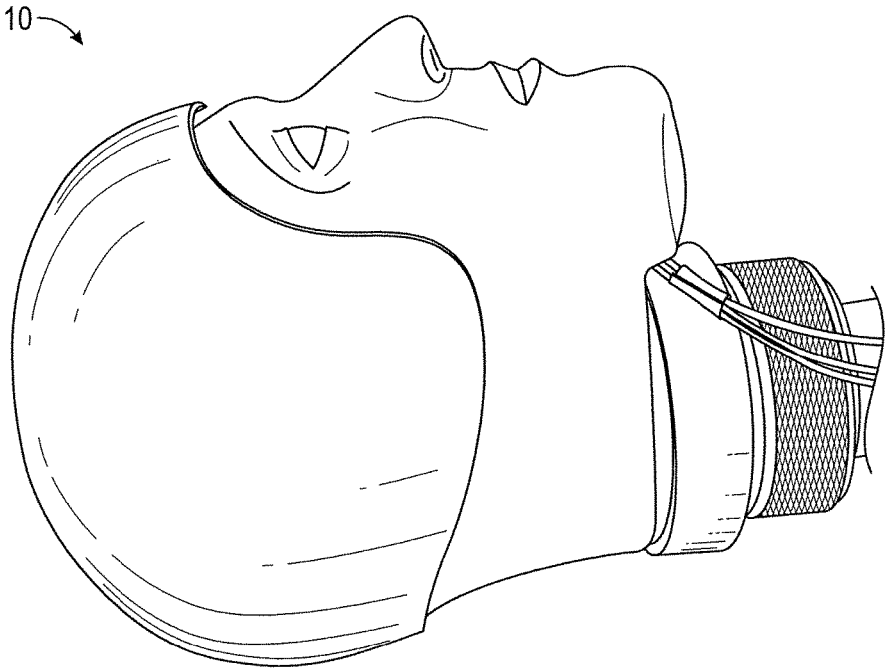
FIG. 5 is a photograph of a headform with an example of the helmet of the present invention.

The National Operating Committee on Standards for Athletic Equipment (NOCSAE) football helmet certification test was carried out at Wayne State University. The helmeted headform was impacted from front, side, and rear locations onto a flat anvil from three impact heights (3 ft, 4 ft, 5 ft) (see TABLE 1, FIG. 4). The helmet used was a large size RIDDELL™ football helmet 2014 model (Riddell, Ill.) (FIG. 6). A medium size NOCSAE headform was used. The head acceleration in x-, y- and z-directions was measured by three accelerometers (Endevco Model 7264-2k, Meggitt, Calif.) mounted at the center of the gravity of the headform. The data was collected using DEWESOFT® SIRIUS® data acquisition system (Dewesoft, Slovenia) at sampling rate of 2,000 S/s. A First Contact product made of 2-3 mm thick graphite material (carbon fiber) was fitted on the NOCSAE mid-size headform (FIG. 5). At each impact height, the helmeted headform was tested first (test repeated twice) and followed by the helmeted-headform wearing the First Contact product (test repeated twice). A total of 54 tests were conducted for this series of study.

TABLE 1

Helmet Drop Test Matrix

| Helmet Impact Location | Drop Height (ft) | RIDDELL ™ Helmet | RIDDELL ™ Helmet with First Contact |
|---|---|---|---|
| Front | 3, 4, 5 | 3 tests at each height | 3 tests at each height |
| Side | 3, 4, 5 | 3 tests at each height | 3 tests at each height |
| Rear | 3, 4, 5 | 3 tests at each height | 3 tests at each height |

Results

The head accelerations measured in x, y, and z direction along with the resultant from each test are shown in TABLE 2. The percentage change of the average resultant head acceleration for each impact condition was calculated. The percentage change is defined as the relative change between the value from with First Contact product and the value from without First Contact product, and divided by the value from without the First Contact product. The highest reduction of head acceleration was in front impact condition followed by the rear impact at 3 and 4 ft. The reduction was small or adverse effect in case of side impact or 5 ft side and rear impact.

TABLE 2

Helmet Drop Test Results

| | W or w/o First Contact | Impact location | Drop height (ft) | Drop velocity (m/s) | Acc_x (g) | Acc_y (g) | Acc_z (g) | Acc_R (g) | Avg Change (%) |
|---|---|---|---|---|---|---|---|---|---|
| 1 | with | rear | 3 | 4.24 | 52.97 | 0.05 | 25.07 | 55.42 | −13% |
| 2 | | | | | 55.22 | 0.08 | 25.5 | 59.64 | |
| 3 | | | | | 59.71 | 0.10 | 25.44 | 63.33 | |
| 4 | | | 4 | 4.89 | 66.78 | 0.21 | 31.52 | 70.36 | −12% |
| 5 | | | | | 66.99 | 0.14 | 37.94 | 74.50 | |
| 6 | | | | | 71.11 | 0.08 | 29.67 | 75.12 | |
| 7 | | | 5 | 5.47 | 78.48 | 7.34 | 69.65 | 98.78 | 6% |
| 8 | | | | | 81.66 | 6.34 | 73.22 | 102.33 | |
| 9 | | | | | 78.08 | 6.79 | 67.35 | 100.69 | |
| 10 | without | rear | 3 | 4.24 | 48.99 | 0.48 | 51.48 | 68.07 | |
| 11 | | | | | 54.92 | 0.07 | 52.88 | 67.22 | |
| 12 | | | | | 59.24 | 0.11 | 52.17 | 70.76 | |
| 13 | | | 4 | 4.89 | 68.89 | 0.14 | 59.93 | 82.74 | |
| 14 | | | | | 64.18 | 0.08 | 61.70 | 84.33 | |
| 15 | | | | | 61.74 | 0.30 | 62.93 | 84.08 | |
| 16 | | | 5 | 5.47 | 73.67 | 13.19 | 69.09 | 92.70 | |
| 17 | | | | | 80.93 | 5.78 | 76.93 | 98.33 | |
| 18 | | | | | 80.72 | 5.05 | 75.73 | 94.08 | |
| 19 | with | side | 3 | 4.24 | 13.55 | 79.20 | 0.20 | 79.75 | −6% |
| 20 | | | | | 13.46 | 80.76 | 0.14 | 80.85 | |
| 21 | | | | | 11.08 | 77.50 | 0.19 | 78.22 | |
| 22 | | | 4 | 4.89 | 13.77 | 92.55 | 0.25 | 93.07 | −5% |
| 23 | | | | | 13.99 | 90.56 | 0.16 | 91.08 | |
| 24 | | | | | 13.10 | 94.38 | 0.11 | 94.60 | |

TABLE 2-continued

Helmet Drop Test Results

| | W or w/o First Contact | Impact location | Drop height (ft) | Drop velocity (m/s) | Acc_x (g) | Acc_y (g) | Acc_z (g) | Acc_R (g) | Avg Change (%) |
|---|---|---|---|---|---|---|---|---|---|
| 25 | | | 5 | 5.47 | 16.94 | 115.20 | 0.15 | 115.33 | 1% |
| 26 | | | | | 16.38 | 114.66 | 0.17 | 115.35 | |
| 27 | | | | | 15.46 | 108.73 | 0.27 | 109.83 | |
| 28 | without | side | 3 | 4.24 | 15.96 | 88.86 | 0.18 | 89.29 | |
| 29 | | | | | 11.65 | 78.11 | 0.17 | 78.40 | |
| 30 | | | | | 7.41 | 87.56 | 0.14 | 87.60 | |
| 31 | | | 4 | 4.89 | 8.56 | 97.91 | 0.23 | 97.92 | |
| 32 | | | | | 9.45 | 93.48 | 0.30 | 93.78 | |
| 33 | | | | | 11.56 | 100.30 | 0.19 | 100.35 | |
| 34 | | | 5 | 5.47 | 10.13 | 120.21 | 0.20 | 120.23 | |
| 35 | | | | | 13.07 | 108.84 | 0.15 | 109.30 | |
| 36 | | | | | 11.84 | 106.57 | 0.16 | 106.83 | |
| 37 | with | front | 3 | 4.24 | 72.86 | 0.00 | 0.13 | 72.86 | −10% |
| 38 | | | | | 74.03 | 0.00 | 0.17 | 74.03 | |
| 39 | | | | | 77.15 | 0.00 | 0.24 | 77.15 | |
| 40 | | | 4 | 4.89 | 108.33 | 0.00 | 0.24 | 108.33 | −16% |
| 41 | | | | | 111.50 | 0.00 | 0.19 | 111.50 | |
| 42 | | | | | 112.56 | 0.00 | 0.22 | 112.56 | |
| 43 | | | 5 | 5.47 | 149.27 | 0.00 | 0.32 | 149.27 | −16% |
| 44 | | | | | 152.21 | 0.00 | 0.38 | 152.21 | |
| 45 | without | front | 3 | 4.24 | 80.61 | 0.00 | 0.24 | 80.61 | |
| 46 | | | | | 83.39 | 0.00 | 0.22 | 83.39 | |
| 47 | | | | | 84.82 | 0.00 | 0.31 | 84.82 | |
| 48 | | | 4 | 4.89 | 130.77 | 0.00 | 0.42 | 130.77 | |
| 49 | | | | | 132.84 | 0.00 | 0.34 | 132.84 | |
| 50 | | | | | 133.83 | 0.00 | 0.22 | 133.83 | |
| 51 | | | 5 | 5.47 | 181.34 | 0.00 | 0.28 | 181.34 | |
| 52 | | | | | 177.34 | 0.00 | 0.35 | 177.34 | |
| 53 | | | | | 180.86 | 0.00 | 0.39 | 180.86 | |

Note: Acc_x, Acc_y, Acc_z, and Acc_R are accelerations in x, y, z directions and the resultant.

2. Computer Modeling of Brain Responses

The magnitude, direction and profile of the head motion can affect the tissue strain patterns, region of the injury in the brain owing to asymmetric anatomy and regional heterogeneous properties of the human head/brain. A detailed, validated computer model of human head based on finite element (FE) technique (Zhang, et al., 2001) was applied to simulate helmet drop tests and helmet-to-helmet impactor tests. The differences in brain responses predicted by the model between the head with and without use of First Contact product were compared and results were to assessed for concussion risk at a given impact condition.

2.1 Simulate Helmet-to-Helmet Linear Impactor Test Method

The helmet-to-helmet frontal linear impactor tests previously conducted by the WSU group with and without the First Contact were simulated using the head model. A total of four sets of 3D translational acceleration and rotational velocity time histories measured from the Hybrid III head with and without the First Contact product was applied to the head model to simulate the impact tests. Various biomechanical responses in the brain including maximum principal strain, maximum strain rate, maximum product of strain times strain rate, and peak brain pressure were calculated, analyzed, and compared between the conditions with and without using First Contact product.

Results

TABLE 3 summarizes the model predicted maximum principal strain, maximum product of strain and strain rate, and peak coup pressure in the brain. These tissue level parameters were previously proposed as relevant concussion injury predictors based on simulations of 58 NFL™ football impact cases using the current head model (Zhang, et al., 2004, Viano, et al., 2005, King, et al., 2003). TABLE 2 demonstrates the effect of First Contact product on the resulting brain strain, product of strain and strain rate, brain pressure values from simulations of two helmet-to-helmet linear impactor tests in frontal direction. A reduction of between 6-13% for brain strain and 10-21% for product of brain strain times strain rate was noted due to the use of First Contact product.

TABLE 3

Biomechanical Response Parameters in the Brian Predicted by the Head Model

| Concussion Injury Predictor | w_test1 | w_test5 | w/o_test1 | w/o_test5 | Percentage Change_test 1 | Percentage Change_test 5 |
|---|---|---|---|---|---|---|
| Max principal strain × strain rate (s−1) | 23 | 27 | 30 | 31 | −21% | −10% |
| Maximum principal strain | 0.50 | 0.53 | 0.57 | 0.58 | −13% | −6% |

TABLE 3-continued

| Biomechanical Response Parameters in the Brian Predicted by the Head Model | | | | | | |
|---|---|---|---|---|---|---|
| Concussion Injury Predictor | w_test1 | w_test5 | w/o_test1 | w/o_test5 | Percentage Change_test 1 | Percentage Change_test 5 |
| Coup Pressure (kPa) | 71.8 | 55.8 | 69.9 | 61.5 | 3% | −9% |

Injury Prediction

Figure 7B:
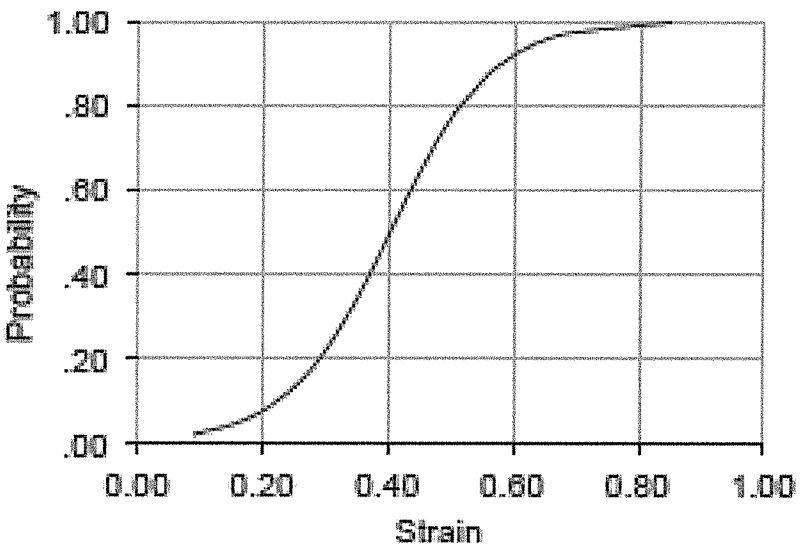
Figure 7A:
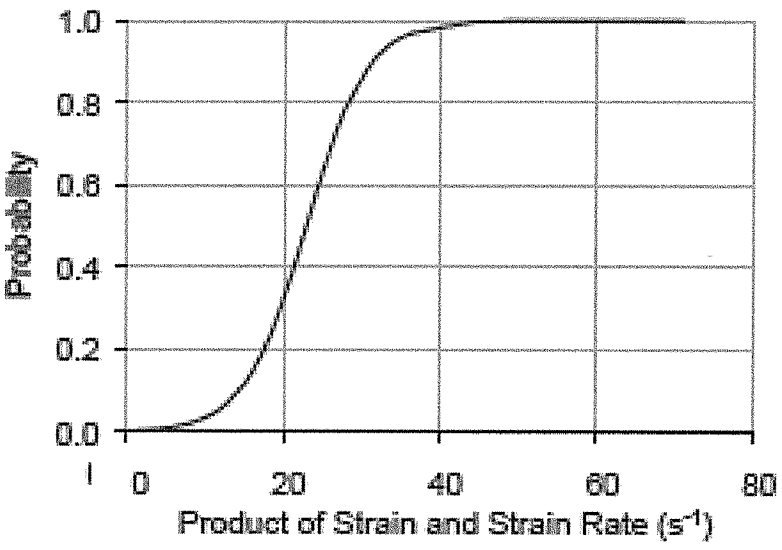

A concussion injury risk curve is presented in FIG. 7A where a 25% probability of injury was predicted with the product of strain times strain rate being 18 $s^{-1}$. Values for the product of strain times strain rate at both 50% and 90% were predicted at 23 $s^{-1}$ and 34 $s^{-1}$, respectively. In the current study, using the product of brain strain and brain strain rate as a predictor for concussion, the helmet only impact had >80% probability of injury with the First Contact product having <60% probability of injury under the simulated impact condition.

A concussion injury risk curve derived from NFL™ concussion studies is presented in FIG. 7B where a 25% probability of injury is predicted with 0.30 strain. Values for strain at both 50% and 90% were predicted at 0.40 and 0.58, respectively. For the current study, based on averaged brain strain response, the model predicted >80% probability of injury with the helmet only in comparison to the model with the use of an additional First Contact product where <65% probability of injury was predicted.

2.2 Simulate Helmet Drop Test

Method

The measured head acceleration data from helmet drop tests were applied to the head model to compute the brain pressure within the brain. A total of 12 representative cases were selected and simulated as shown TABLE 4.

TABLE 4

| Simulation matrix | | | |
|---|---|---|---|
| Impact Location | Drop Height (ft) | RIDDELL ™ Helmet Only | RIDDELL ™ Helmet with First Contact |
| Front, side, rear | 4, 5 | Total 6 cases simulated | Total 6 cases simulated |

Results

TABLES 5-7 summarize the peak values of intracranial pressure and pressure rate predicted by the head model for frontal, side and rear drop tests. The percentage reduction of the response values due to the use of the First Contact product was also calculated. The reduction of brain pressure was significant in frontal impact cases (5 and 4 ft drop heights). There was, however, no or little effect due to the use of the First Contact product in case of side and rear impact. Note that the reduction of brain pressure rate response was more profound as compared to that of brain pressure response for all impact conditions. In addition, pressure rate reduction was higher in 4 ft drop group than in 5 ft drop group for all impact directions.

TABLE 5

| Summary of model prediction from frontal drop test | | | |
|---|---|---|---|
| Pressure Response | Model Case | Peak Values | Difference: w vs w/o |
| Pressure (kPa) | front_w_4ft | 105 | −17% |
| | front_w_5ft | 140 | −17% |
| | front_wo_4ft | 126 | |
| | front_wo_5ft | 169 | |
| Pressure rate (kPa/ms) | front_w_4ft | 45 | −46% |
| | front_w_5ft | 58 | −39% |
| | front_wo_4ft | 83 | |
| | front_wo_5ft | 96 | |

TABLE 6

| Summary of model prediction from side drop test | | | |
|---|---|---|---|
| Pressure Response | Model Case | Peak Values | Difference: w vs w/o |
| Pressure (kPa) | side_w_4ft | 70.4 | −1% |
| | side_w_5ft | 85.6 | −3% |
| | side_wo_4ft | 70.9 | |
| | side_wo_5ft | 88.7 | |
| Pressure rate (kPa/ms) | side_w_4ft | 17.9 | −19% |
| | side_w_5ft | 21.0 | −13% |
| | side_wo_4ft | 22.2 | |
| | side_wo_5ft | 24.0 | |

TABLE 7

| Summary of model prediction from rear drop test | | | |
|---|---|---|---|
| Pressure Response | Model Case | Peak Values | Difference: w vs w/o |
| Pressure (kPa) | rear_w_4ft | 49 | 0% |
| | rear_w_5ft | 89 | −3% |
| | rear_wo_4ft | 49 | |
| | rear_wo_5ft | 86 | |
| Pressure rate (kPa/ms) | rear_w_4ft | 24 | −9% |
| | rear_w_5ft | 40 | −21% |
| | rear_wo_4ft | 31 | |
| | rear_wo_5ft | 44 | |

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A total contact helmet, comprising a body made completely from carbon fiber capable of distributing the force of an impact to a large surface area of said body by transmitting force of impact laterally and decreasing pressure as the force is transmitted through the body, said body being a layer having an inner surface configured to be in contact with a surface of an individual's head when worn and an outer surface exposed to the environment, wherein said layer is continuously formed from said inner surface to said outer surface.

2. The total contact helmet of claim 1, wherein said body is configured to laterally displace force and disperse an impact vector to a large area of said body.

3. The total contact helmet of claim 1, wherein a property of said body is being able to spread an impact to a large surface area of said body and decrease pressure to the individual's skull and brain.

4. The total contact helmet of claim 1, wherein said total contact helmet is customizable based on a mechanism chosen from the group consisting of a cast and mold, and 3D scanning.

5. The total contact helmet of claim 1, wherein said body is made of at least two pieces and held together by at least one interlock.

6. The total contact helmet of claim 1, wherein said body is a single piece.

7. The total contact helmet of claim 1, further including cut outs located in areas of the body that are configured to correspond to areas of the individual chosen from the group consisting of a mouth, a nose, ears, a chin, a neck, a ponytail, and combinations thereof.

8. The total contact helmet of claim 1, further including a ventilation mechanism chosen from the group consisting of holes and slits.

* * * * *